United States Patent [19]

Allen

[11] 3,972,168

[45] Aug. 3, 1976

[54] TYING DEVICE FOR TYING A WOOD FRAMING STRUCTURE TO A MASONRY WALL

[76] Inventor: George E. Allen, 15513 S. Dobson, Dolton, Ill. 60419

[22] Filed: Nov. 8, 1974

[21] Appl. No.: 522,010

[52] U.S. Cl. ..... 52/698; 52/442; 52/702; 52/713

[51] Int. Cl.[2] ..... E04C 5/18

[58] Field of Search ..... 52/61, 59, 702, 713, 52/714, 753 Y, 434, 435, 442, 369, 373, 372

[56] References Cited

UNITED STATES PATENTS

| | | | |
|---|---|---|---|
| 936,322 | 10/1909 | Jeffers | 52/373 |
| 1,803,141 | 4/1931 | Paulissen | 52/714 |
| 1,963,153 | 6/1934 | Schmieder | 52/373 |
| 2,625,815 | 1/1953 | Black | 52/707 |
| 2,776,559 | 1/1957 | Summers | 52/442 |
| 2,903,879 | 9/1959 | Williams | 52/713 |
| 3,385,156 | 5/1968 | Polos | 85/71 |
| 3,420,031 | 1/1969 | Castelli | 52/442 |

FOREIGN PATENTS OR APPLICATIONS

| | | | |
|---|---|---|---|
| 711,711 | 6/1966 | Italy | 85/67 |
| 652,893 | 5/1951 | United Kingdom | 52/713 |

*Primary Examiner*—Ernest R. Purser
*Assistant Examiner*—Henry Raduazo
*Attorney, Agent, or Firm*—Charles B. Cannon

[57] ABSTRACT

A tying device for tying a wood framing structure to a masonry block, brick or concrete surface comprising a clamping and fastening unit which includes a combination clamping and fastening member which in use is disposed outwardly of the masonry or concrete wall and is adapted to be clamped against and to be fastened to the wood framing structure. The new tying device includes a sleeve unit which is adapted to be inserted into either mortar joints or concrete and cooperates with the combination clamping and fastening unit to enable the clamping and fastening member to be moved and adjusted into and out of clamping position against a vertically extending outer wall surface of a masonry or concrete wall surface. The new tying device also includes coacting threaded means on the combination clamping and fastening unit and on the sleeve unit operable from the inner side of the masonry or concrete wall for securing the combination clamping and fastening unit and the sleeve unit together and for urging the combination clamping and fastening member on the combination clamping and fastening unit into clamping and fastening engagement with a structural unit of a wood framing structure. The new tying device thus enables a wood framing structure, such as a mansard roof, to be tied to a masonry block, brick or concrete wall construction without requiring the building mechanic to be on and to work from the same side of the wall surface as the wood framing structure which is being attached to the wall surface during the tying operation.

17 Claims, 9 Drawing Figures

TYING DEVICE FOR TYING A WOOD FRAMING STRUCTURE TO A MASONRY WALL

OBJECTS

An object of the invention is to provide a new and improved tying device for tying a structural unit of a wood framing structure such, for example, as a mansard roof, to a masonry block, brick or concrete wall surface.

Another object of the invention is to provide a new and improved tying device for tying a structural unit of a wood framing structure, such as a mansard roof, to a concrete block, brick or like concrete wall surface which includes a combination clamping and fastening unit, which is adapted to be clamped against the outer surface of a structural unit of a wood framing structure, and a sleeve unit which is adapted to be disposed in the horizontal mortar or like joint of a concrete block, brick or concrete wall construction and which sleeve unit includes a member which is adapted to be disposed against the outer vertical wall surface of a concrete block, brick or concrete wall construction, and coacting threaded fastening means on the combination clamping and fastening unit and on the sleeve unit operable from inside the concrete block, brick or concrete wall construction for urging the combination clamping and fastening unit and the sleeve unit into clamping engagement with each other and for urging the combination clamping and fastening member on the combination clamping and fastening unit into clamping and fastening engagement with the structural unit of the wood framing structure.

An additional object of the invention is to provide a new and improved tying device for tying a wood framing structure to a masonry block, brick or concrete wall structure which eliminates the necessity for cutting or chipping masonry to install the tying device in position of use.

A further object of the invention is to provide a tying device for the purposes stated having the novel features of construction and the novel mode of operation herein disclosed.

DESCRIPTION OF FIGURES IN THE DRAWINGS

Figure 1:
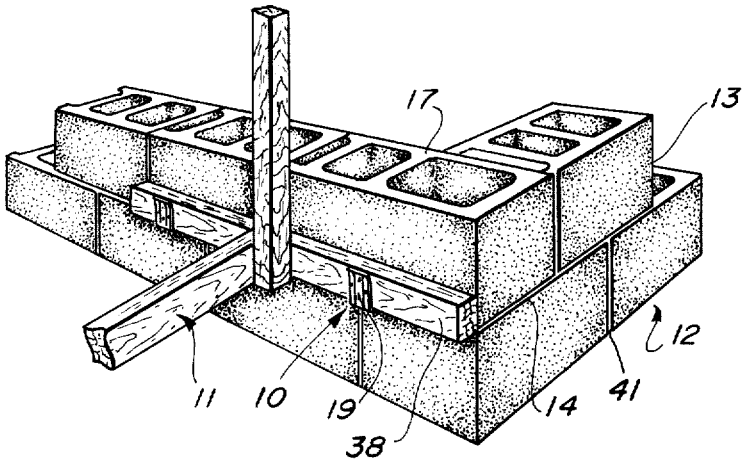
FIG. 1 is a fragmentary perspective view of a concrete block masonry wall construction and of a part of a wood framing structure tied thereto by the new tying device.

DETAILED DESCRIPTION OF THE PREFERRED EMBODIMENT OF THE NEW TYING DEVICE SHOWN IN FIGS. 1 TO 7, INCLUSIVE, OF THE DRAWINGS

A preferred embodiment of the new tying device is illustrated in FIGS. 1 to 7, inclusive, of the drawings, wherein it is generally indicated at 10, and is shown as being employed for a typical use thereof, namely, for tying a structural member or part, as 38, of a wood framing structure 11, to a masonry wall 12 which is shown as having the form of a concrete block wall having an outer wall surface 44 and which includes concrete blocks 13 suitably jointed together by mortar joints including horizontal mortar joints 14 and vertically extending mortar joints, as 41, and each of the concrete blocks having a horizontal upper surface, as 17, and a horizontal bottom surface, as 48.

The new tying device 10 includes a pair of telescopically interconnectable units including a combination clamping and fastening unit 15 which includes a base plate member 18 which is shown as being generally rectangular in form, and as having reinforcing ribs 16 formed therein. The combination clamping and fastening unit 15 may be made of any suitable metal, such, for example, as steel, aluminum or the like, and by any suitable means and method.

Figure 2:
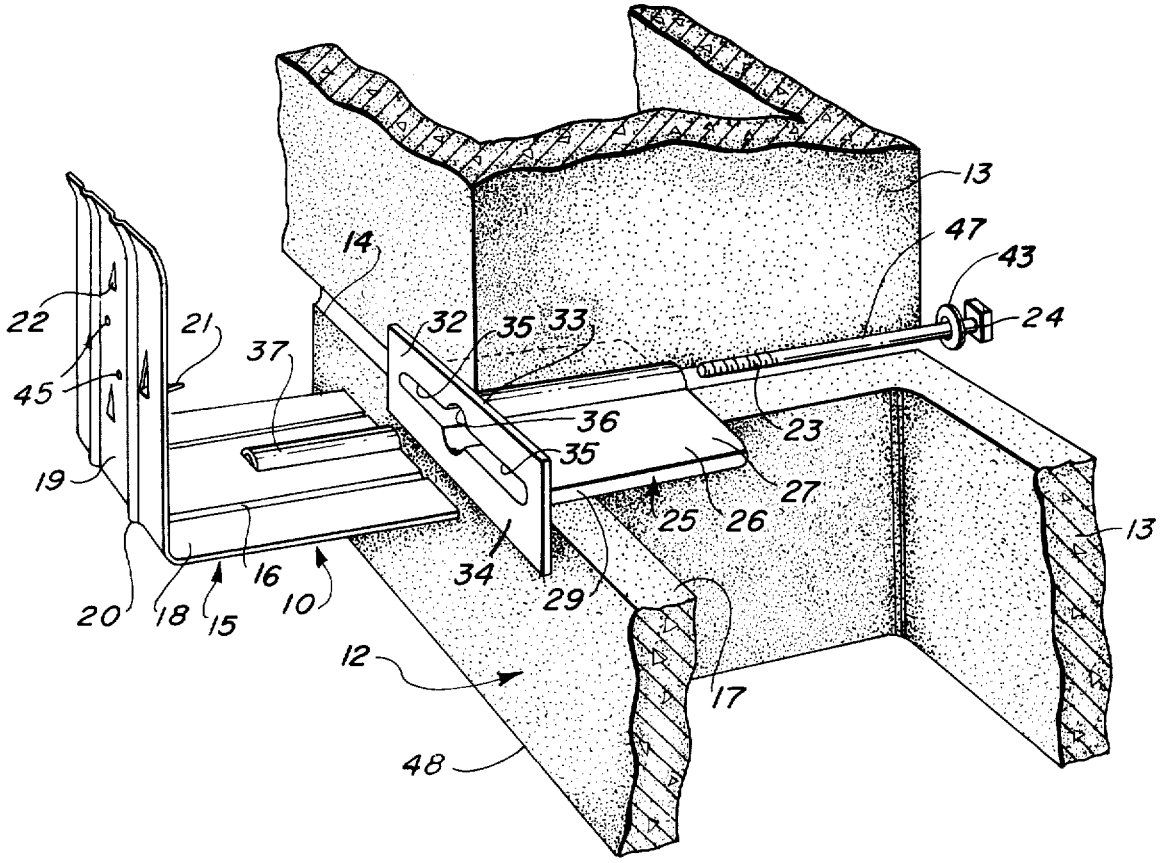
FIG. 2 is an enlarged fragmentary perspective view illustrating the parts of the new tying device disassembled and in relationship to a concrete block wall construction.
Figure 3:
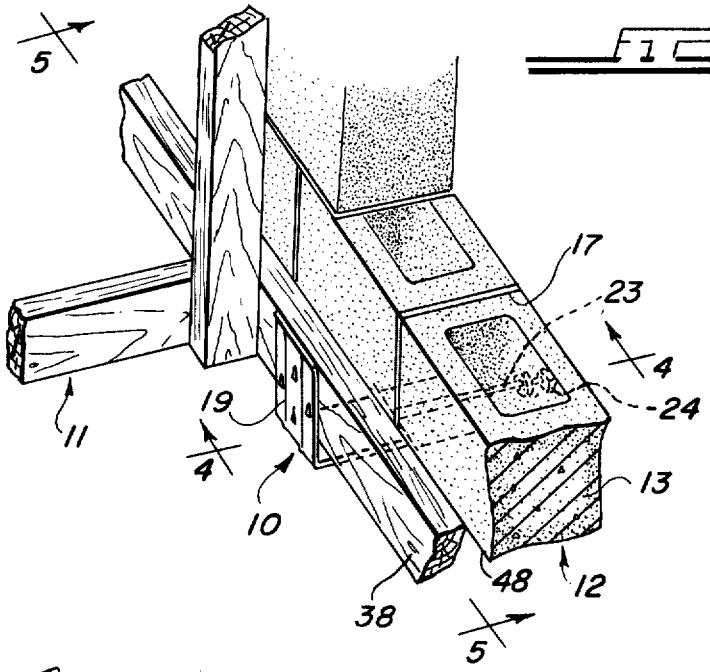
FIG. 3 is a fragmentary perspective view of a concrete block wall construction and a wood framing structure tied together by the new tying device.
Figure 4:
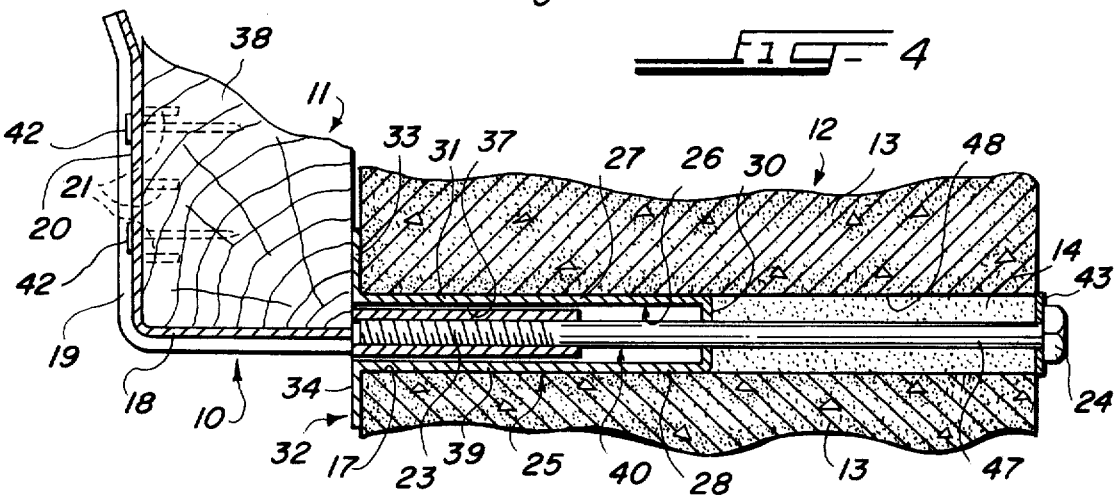
FIG. 4 is an enlarged sectional view on line 4—4 in FIG. 3.

The base plate member 18 of the combination clamping and fastening unit 15 includes a combination clamping and fastening member 19 which is in the form of a flange which is formed integrally with the base plate member 18 and in use projects upwardly from the base plate member 18, exteriorly of the masonry wall 12, and upwardly over and against the outer surface of the wooden member or like structural part 38 of the wood framing structure 11. The combination clamping and fastening member 19 has reinforcing ribs, as 20, formed integrally therein on its outer surface and it also has a series of fastening elements in the form of piercing points or prongs 21 formed integrally therein and which are adapted to be projected into and to be fastened to the wooden structural member 38 of the wood framing structure 11 (FIGS. 2 and 4). The piercing elements or prongs are preferably formed by stamping or otherwise striking our portions of the metallic body of the upwardly projecting clamping and fastening member 19—20.

Figure 6:
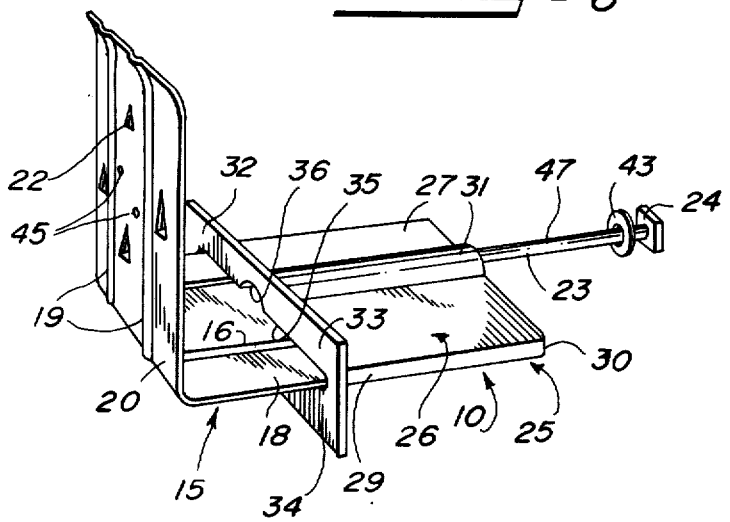
FIG. 6 is a perspective view of the parts of the new tying device in assembled relationship.
Figure 7:
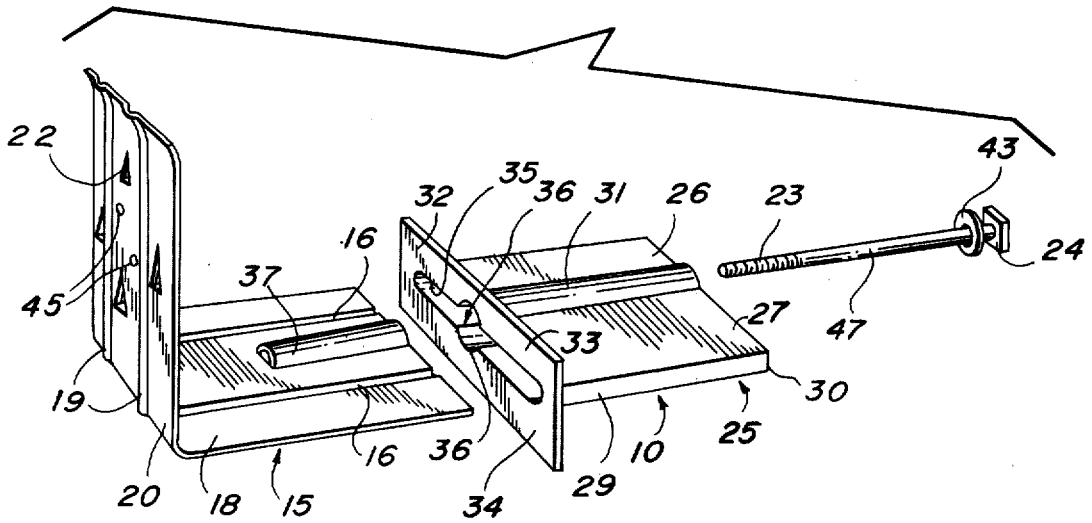
FIG. 7 is an exploded perspective view of the form of the new tying device shown in FIGS. 1 to 6, inclusive, in disassembled relationship.

Nail holes 45 are also provided in the upwardly projecting clamping and fastening member 19–20 for the reception of nails 42 further to facilitate fastening the clamping and fastening member 19–20 to the wooden structural member 38 of the wood framing structure 11 (FIGS. 2, 4 and 6). However, in some instances it may not be necessary to employ the piercing prongs or points 21 since the fastening nails 42 are sufficient in some instances.

The new tying device includes a second telescopically interconnectable unit in the form of a sleeve unit 25 which includes a hollow sleeve member 26 which includes vertically spaced parallel top and bottom walls 27 and 28, respectively, which are formed integrally with each other and are integrally interconnected by side walls 29 and an end wall 30 (FIGS. 4, 5, 6 and 7). The top wall 27 of the hollow sleeve member 26 has a raised portion 31 which extends centrally thereof and the bottom wall 28 of the hollow sleeve member 26 has a similar centrally arranged depressed portion 39 which cooperates with the part 31 to form part of a centrally arranged tubular sleeve or channel 40 in the hollow sleeve member 26 of the sleeve unit 25, for a reason which will be pointed out presently.

The sleeve unit 25 includes a generally rectangular-shaped flange member 32 which is formed integrally with the hollow sleeve member 26 at the inner end of the latter. This flange member 32 extends rightangularly across the hollow sleeve member 26 and has an upper portion 33 which projects above the top wall 27 of the hollow sleeve member 26 and a lower portion 34 which extends below the bottom wall 28 of the hollow sleeve member 26.

Figure 5:
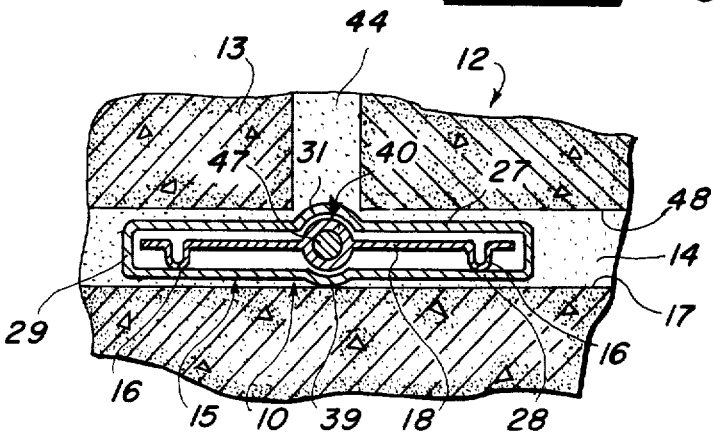
FIG. 5 is a fragmentary sectional view on line 5—5 in FIG. 3.

The flange member 32 has a transversely extending slot 35 formed therein and this slot 35 has an enlarged generally annular central portion 36 which forms the mouth or inlet to the tubular sleeve or channel 40 in the hollow sleeve member 26, and is adapted to receive a threaded fastening means in the form of a centrally arranged internally threaded tubular section 37 which is formed integrally in and as a part of the base plate member 18 of the combination clamping and fastening unit 15, with part of the internally threaded tubular section 37 extending above and a part extending below the body of the base plate member 18, as shown in FIGS. 4 and 5.

The new tying device 10 includes a second threaded fastening means in the form of an elongated threaded bolt 47 which has a threaded outer end portion 23 and a head 24 at its inner end, with a washer 43 mounted on the threaded bolt member 22 inwardly of the head 24 of the threaded bolt member 22 (FIG. 2).

The new tying device 10 may be positioned in different and various positions on a concrete block, brick or concrete wall surface and one typical position of use thereof is shown in FIG. 5 in which it will be noted that the centrally depressed portion 39 of the bottom wall 28 of the hollow sleeve unit 25 rests on the upper horizontal surface 17 of the underlying concrete block 13 with the raised central portion 31 of the upper wall 27 of the hollow sleeve unit 25 being disposed substantially flush with the horizontal bottom surface 48 of the overlying concrete block 13 and being substantially flush with the bottom surface of the overlying vertical mortar joint 44.

ASSEMBLY AND USE OF THE FORM OF THE TYING DEVICE ILLUSTRATED IN FIGS. 1 TO 7, INCLUSIVE

In a typical use of the preferred embodiment of the new tying device as illustrated in FIGS. 1 to 7, inclusive, of the drawings, for fastening a wooden structural member or part, as 38, of a wood framing structure 11 to a masonry or concrete wall 12, the hollow sleeve unit 25 is laid horizontally over the upper surface 17 of the concrete block or like masonry wall construction 12 during the construction thereof, so that it will lie in one of the horizontal mortar joints 14, with the flange member 32 extending vertically adjacent the vertically extending outer wall surface of the concrete block or like masonry wall 12–13 and with the flange member 32 spanning the horizontal mortar joint 14 (FIG. 2).

The combination clamping and fastening unit 15 is then operatively fastened to the hollow sleeve unit 25 by inserting the horizontal base portion 18 thereof through the transverse slot 32–35–36 in the vertically extending flange member 32–33–34 and with the first threaded fastening member in the form of the internally threaded tubular member 37 of the combination clamping and fastening unit 15 projecting centrally into the body of the hollow sleeve member 26–27–29–30 of the hollow sleeve unit 25, as shown in FIGS. 4, 5, and 6, and with the upwardly projecting clamping member 19–20 of the combination clamping and fastening unit 15 being disposed adjacent the outer surface of the structural wooden member or part 38 of the wood framing structure 11. The second threaded fastening means, in the form of the threaded fastening bolt member 47, is then inserted through the centrally arranged unthreaded section 31–39–40 of the hollow sleeve member 26–27–28 of the sleeve unit 25 and into coacting threaded engagement with the second threaded fastening means in the form of the internally threaded tubular section 37 of the combination clamping and fastening unit 15.

The fastening bolt member 47 is then manually rotated and tightened into position of use in the internally threaded tubular section 37 of the combination clamping and fastening unit 15, thereby drawing the combination clamping and fastening unit 15 and the sleeve unit 25 into telescopic relationship. This action causes the upwardly extending clamping and fastening flange member 19–21 on the combination clamping and fastening unit 15 to be drawn into clamping and fastening engagement with the wooden structural member 38 of the wood framing structure 11 while, at the same time, urging the wooden structural unit 38 of the wood framing structure 11 into engagement with the vertically extending flange member 32 on the sleeve unit 25 and urging the latter against the outer wall surface 44 of the masonry wall 12.

At the same time, this action causes the piercing prongs or elements 21 on the upwardly extending clamping and fastening member 19 of the combination clamping and fastening unit 15 to penetrate into and to become embedded in the body of the wooden part or structural member 38 of the roof framing structure 11, and the fastening of the upwardly clamping and fastening member to the wooden structural member 38 may be further facilitated or enhanced by driving fastening nails, as 43, through the nail holes 45 into the wooden structural member 38.

In this manner the wood framing structure 11 may be fastened to the masonry or concrete wall construction 12–13 from the inside of the masonry or concrete wall 12–13 and without the necessity for the building mechanic to work from outside the building structure to the wood framing structure 11 to the concrete or like masonry wall 12–13, thereby simplifying the tying operation and reducing the risks and hazards to the workman incidental thereto.

The flange member 32 on the sleeve unit 25 assures that the mechanic who installs the new tying device 10 will position or set the sleeve unit 25 in proper position or location with respect to the outer face 44 of the wall 12 and prevents the sleeve unit 25 from being set too deeply in the vertical mortar joint 41 while, at the same time, the flange member 32 is urged into tight engagement with the vertically extending outer wall surface 44 of the wall 12 by the coacting threaded fastening means 37 and 47.

THE MODIFICATION SHOWN IN FIGS. 8 AND 9

Figure 8:
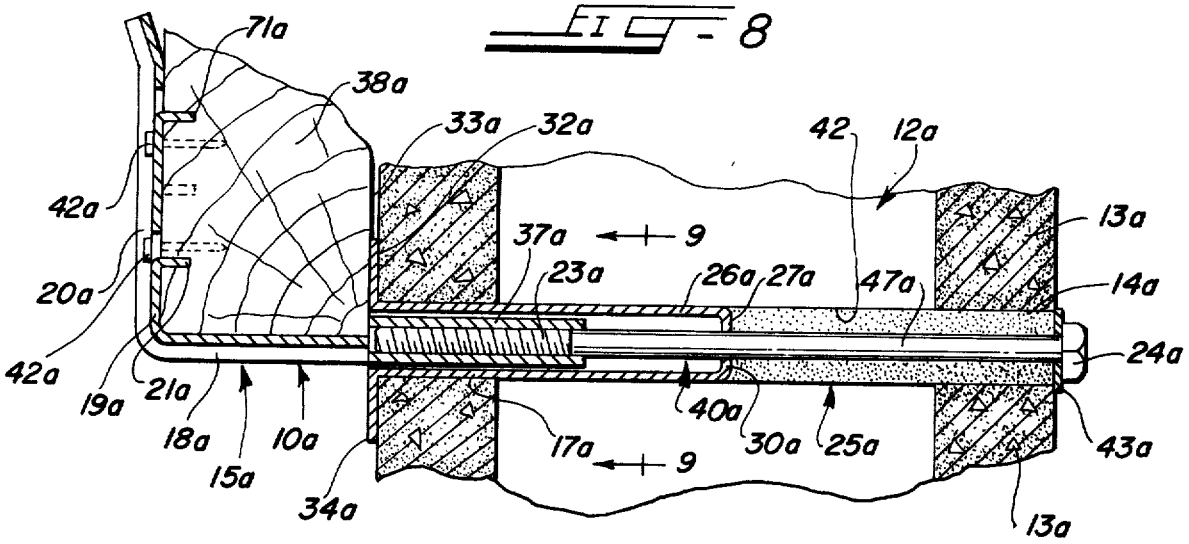
FIG. 8 is a sectional view illustrating a modified form of construction of the invention.
Figure 9:
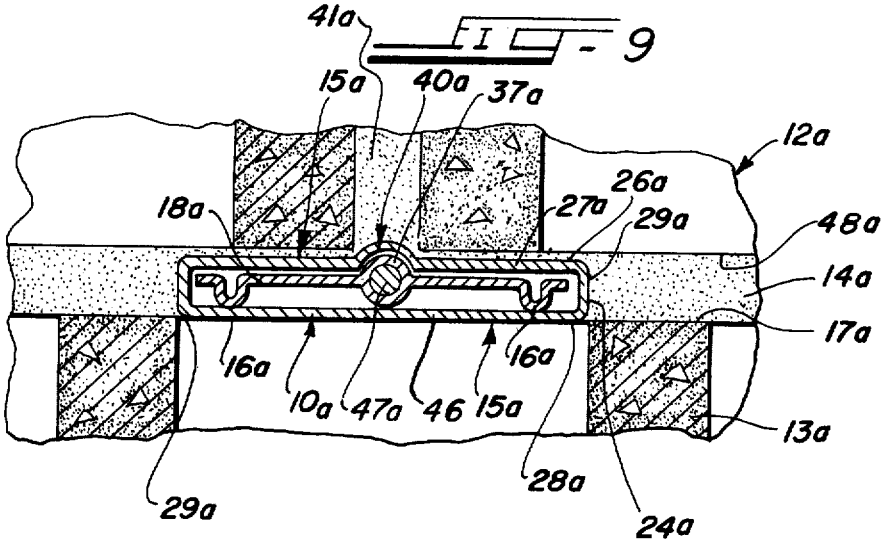
FIG. 9 is a transverse sectional view on line 9—9 in FIG. 8.

A modification of the invention is illustrated in FIGS. 8 and 9 of the drawings and those parts thereof which are similar to or correspond to parts of the invention illustrated in FIGS. 1 to 7, inclusive, have been given the same reference numerals followed by the additional and distinguishing reference character *a*.

The modified form of the invention illustrated in FIGS. 8 and 9 of the drawings is substantially similar to the forms of the invention illustrated in FIGS. 1 to 7, inclusive, but differs therefrom in omitting the longitudinally extending depending rib portion 39 of the sleeve unit 25, thereby providing a flat bottom surface on the bottom wall 46*a* of the sleeve unit 25*a*. This enables the center portion of the sleeve unit 25*a* to project higher into the vertical mortar joint 41*a* thereabove than is the case with the preferred embodiment of the invention illustrated in FIGS. 1 to 7, inclusive, thus enhancing the permanency of the mounting of the tying device 10*a* (compare FIGS. 5 and 9).

Thus, it will be noted by reference to FIG. 9 that the horizontal bottom wall 28*a* of the sleeve unit 25*a* rests on the upper horizontal surface 17*a* of the underlying concrete block 13*a* and that the raised center portion 31*a* of the top wall 27*a* projects upwardly somewhat further into the vertical mortar joint 41*a*, than is the case with the form of the invention illustrated in FIGS. 1 to 7, inclusive, thereby increasing or enhancing the bonding between the sleeve unit 25*a* and the vertical mortar joint 41*a* (FIG. 9), and thereby bonding the raised center portion 31*a* of the top wall 37*a* of the hollow sleeve unit 25*a* in the vertical mortar joint 44*a*.

It will thus be seen from the foregoing description, considered in conjunction with the accompanying drawings, that the present invention provides a new and improved tying device for tying a wood framing structure to a concrete block, brick or concrete wall, and thus has the desirable advantages and characteristics and accomplishes its intended objects, including those hereinbefore pointed out and others which are inherent in the invention.

I claim:

1. A tying device for tying a structural member of a wood framing structure to a masonry wall which includes a wall body having a vertically extending outer wall surface and including masonry wall units having horizontally extending upper and lower wall surfaces and vertically and horizontally extending mortar joints between the said masonry wall units comprising:

a. a combination clamping and fastening unit including a base plate member having
   1. an inner end; and
   2. an outer end; the said base plate member having
   3. a clamping flange member at the outer end thereof and projecting generally right-angularly and vertically upwardly therefrom;

b. a sleeve unit including
   1. a hollow sleeve member adapted to be disposed in and to lie horizontally within one of the said horizontally extending mortar joints in the said wall body of the said masonry wall; the said combination clamping and fastening unit including c. first threaded fastening means on the said base plate member of the said combination clamping and fastening unit;

d. the said sleeve unit including second threaded fastening means carried by the said hollow sleeve member of the said hollow sleeve unit and adapted to be threaded into coacting threaded engagement with the said first threaded fastening means to draw the said clamping flange member on the said base plate member into claping engagement with the said structural member of the said wood framing structure; the said hollow sleeve member of said sleeve unit including e. a substantially flat bottom surface adapted to rest on the horizontal wall surface of one of the said masonry wall units; and f. the said hollow sleeve member of the said sleeve unit including
   1. a raised horizontally extending central portion which is adapted to project into and to be anchored in one of the said vertically extending mortar joints of the said masonry wall.

2. A tying device for tying a structural member of a wood framing structure to a masonry wall which includes a wall body having a vertically extending outer wall surface embodying mortar joints including horizontally extending mortar joints comprising:

a. a combination clamping and fastening unit including a generally flat rectangular-shaped base plate member having
   1. an inner end; and
   2. an outer end; the said base plate member having
   3. a generally flat rectangular-shaped clamping flange member at the outer end thereof and projecting generally right-angularly and vertically upwardly therefrom;

b. a sleeve unit including
   1. a generally flat rectangular-shaped hollow sleeve member adapted to be disposed in and to lie horizontally within one of the said horizontally extending mortar joints in the said wall body of the said masonry wall; the said combination clamping and fastening unit including c. first threaded fastening means on the said generally flat rectangular-shaped base plate member of the said combination clamping and fastening unit and disposed between the said inner end and the said outer end of said generally flat rectangular-shaped base plate member; and d. the said sleeve unit including second threaded fastening means carried by the said generally flat rectangular-shaped hollow sleeve member of the said hollow sleeve unit and adapted to be projected through the said generally flat rectangular-shaped hollow sleeve member into coacting threaded engagement with the said first threaded fastening means to draw the said generally flat rectangular-shaped clamping flange member on the said base plate member into clamping engagement with the said structural member of the said wood framing structure.

3. A tying device as defined in claim 2 in which a. the said generally flat rectangular-shaped clamping flange member on the said base plate member of the said combination clamping and fastening unit includes
   1. an inner surface facing toward the said sleeve unit; and in which
   2. the said generally flat rectangular-shaped clamping flange member has
   3. fastening means on its inner surface adapted to be engaged with and fastened to the said structural member of the said wood framing structure when the said first threaded fastening means and the said second threaded fastening means are drawn into coacting threaded engagement with each other.

4. A tying device as defined in claim 3 in which
a. the said fastening means is in the form of piercing elements formed integrally with and on the said generally flat rectangular-shaped flange member and adapted to penetrate into the said wooden structural member of the said wood framing structure when the said combination fastening and clamping unit and the said sleeve unit are fastened together by the coaction of the said first and second threaded fastening means.

5. A tying device as defined in claim 2 in which
a. the said generally flat rectangular-shaped base plate member of the said combination clamping and fastening unit and the said generally flat rectangular-shaped hollow sleeve member of the said sleeve unit are telescopically interconnectable and are drawn into telescoping interconnected engagement with each other by the coaction of the said first and second threaded fastening means.

6. A tying device as defined in claim 2 in which the said generally flat rectangular-shaped hollow sleeve member includes
a. a generally flat rectangular-shaped flange member formed integrally with the said generally flat rectangular-shaped hollow sleeve member of the said hollow sleeve unit and extending generally right-angularly and vertically upwardly from the said hollow sleeve member in spaced relationship to but generally parallel to the said generally flat rectangular-shaped clamping flange member on the said combination clamping and fastening unit.

7. A tying device in claim 2 in which
a. the said first threaded fastening means is in the form of an internally threaded bore formed in the said generally flat rectangular-shaped base plate member of the said combination clamping and fastening unit; and in which
b. the said second threaded fastening means is in the form of an externally threaded fastening member adapted to be manually projected through the said generally flat rectangular-shaped hollow sleeve member into threaded engagement with the said internally threaded bore in the said generally flat rectangular-shaped base plate member of the said combination clamping and fastening unit.

8. A tying device as defined in claim 2 in which the said masonry wall includes masonry units each having a horizontally extending upper surface and in which the said generally flat rectangular-shaped hollow sleeve member includes
a. a bottom wall having
1. a centrally arranged depressed center portion which is adapted to rest upon the said horizontally extending upper surface of one of the said masonry units.

9. A tying device as defined in claim 2 in which the said masonrywallincludes masonry wall united each having a horizontally extending upper surface and in which the said generally flat rectangular-shaped hollow sleeve member includes
a. a bottom wall having
1. a centrally arranged substantially flat bottom wall which is adapted to rest upon the said horizontally extending upper surface of one of the said masonry units.

10. A tying device for tying a structural unit of a wood framing structure to a masonry wall which includes horizontally extending masonry wall components having horizontally extending mortar joints therebetween and having vertically extending inner and outer wall surfaces, comprising
a. a clamping unit including
1. a generally flat rectangular-shaped base plate member adapted to be disposed within one of the said horizontally extending mortar joints;
2. a generally flat rectangular-shaped clamping member projecting generally right-angularly upwardly from the said generally flat rectangular-shaped base plate member and adapted to engage the said structural unit of the said wood framing structure and to urge the said structural unit into clamping relationship with the said vertically extending outer wall surface of the said masonry wall;
b. a generally flat rectangular-shaped sleeve unit including
1. a hollow body adapted to be disposed in one of the said horizontally extending mortar joints of the said masonry wall; and the said hollow body having therein
a. an inlet for the reception and passage of the said generally flat rectangular-shaped base plate member into the said hollow body of the said generally flat rectangular-shaped sleeve unit;
c. said clamping unit and the said hollow body of said sleeve unit including
1. coacting threaded fastening means for moving the said generally flat rectangular-shaped base plate member of the said clamping unit into the said hollow body of the said sleeve unit through the said inlet into the said hollow body of the said sleeve unit and for moving the said generally flat rectangular-shaped clamping member into clamping relationship with the said structural unit of the said wood framing structure.

11. A tying device as defined in claim 10 in which the said hollow body of the said sleeve unit includes
a. a generally flat rectangular-shaped vertically extending flange member adapted to be disposed against the said vertically extending outer wall surface of the said masonry wall; and in which the said generally flat rectangular-shaped vertically extending flange member includes
1. an upper portion projecting above the said generally flat rectangular-shaped base plate member; and
2. a lower portion projecting below the said generally flat rectangular-shaped base plate member.

12. A tying device as defined in claim 11 in which the said generally flat rectangular-shaped vertically extending flange member has
a. a slot formed therein between the said upper and lower portions thereof for the reception of the said generally flat rectangular-shaped base plate member of the said combination clamping and fastening unit and providing the said inlet for the reception and passage of the said generally flat rectangular-shaped base plate member into the hollow body of the said sleeve unit.

13. A tying device comprising the combination of
a. a pair of telescopically interconnectable units, including
b. a first telescopically interconnectable unit in the form of a clamping unit including 1. a generally flat rectangular-shaped base plate member including
   a. a body portion;
2. a generally flat rectangular-shaped clamping flange member on the said base plate member and the said clamping flange member extending generally rightangularly upwardly from the said body portion of the said base plate member;

c. a second and generally flat rectangular-shaped hollow sleeve member telescopically interconnectable with the said generally flat rectangular-shaped base plate member;

d. coacting threaded means on the said generally flat rectangular-shaped base plate member and in the said generally flat rectangular-shaped hollow sleeve member for moving the said telescopically interconnectable units into interconnected relationship with each other and for moving the said generally flat rectangular-shaped clamping flange member relative to and toward the said generally flat rectangular-shaped hollow sleeve member.

14. A tying device comprising the combination of a. a pair of telescopically interconnectable units, including b. a first telescopically interconnectable unit in the form of a clamping unit including
   1. a base plate member including
      a. a body portion;
   2. a clamping flange member on the said base plate member and said clamping flange member extending generally right-angularly from the said body portion of the said base plate member;

c. a second telescopically interconnectable unit adapted to be telescopically interconnected with the said clamping unit; and d. coacting threaded means on the said first and second telescopically interconnectable units for urging the said telescopically interconnectable units into telescopically interconnected relationship with each other and for moving the said clamping flange member relative to and toward the said second telescopically interconnectable unit;

e. the said second telescopically interconnectable unit including
   1. a hollow body member having
      a. a hollow interior adapted to telescopically receive the said base plate member and the said body portion of the said clamping unit;

f. the said coacting threaded means including
   1. a first threaded means on the said base plate member of the said clamping unit; and
   2. a second threaded means adapted to be inserted through the said hollow body member into coacting threaded engagement with the said first threaded means for moving the said base plate member and the said clamping flange member thereon toward the said second telescopically interconnectable unit;

g. the said first threaded means having the form of an internally threaded bore formed in the said base plate member of the said clamping unit; and h. the said second threaded means having the form of an externally threaded member adapted to be inserted through the said hollow interior of the said hollow body member into threaded engagement with the said internally threaded bore of the said base plate member.

15. A tying device for tying a wood framing structure to a masonry block, brick or concrete wall having an inner surface and an outer surface and which includes wall units interconnected by mortar joints including horizontally extending mortar joints, and in which the wood framing structure includes a structural unit, comprising:

a. a combination clamping and fastening unit including
   1. a generally rectangular-shaped base plate member including a body having
      a. inner and outer ends; and
      b. generally parallel side walls; and
      c. an internally threaded central tubular section formed integrally with the said body of the said base plate member and extending generally centrally thereof between the said side walls thereof and having an open inner end at the said inner end of the said body of the said generally rectangular-shaped base plate member;
   2. said base plate member including
      a. a combination clamping and fastening member formed integrally with the said body thereof and projecting generally rightangularly upwardly from the said body of the said base plate member;
   3. a sleeve unit including
      a. a generally rectangular-shaped hollow sleeve member adapted to lie in one of the said horizontally extending mortar joints of the said masonry wall and including a body having
         1. a hollow interior;
         2. generally parallel side walls; and
         3. generally parallel inner and outer end walls; and the said outer end wall having
            —a. an open inner end opening into the said hollow interior of the said generally rectangular-shaped hollow sleeve member of the said sleeve unit;

b. a flange member formed integrally with the said body of the said hollow sleeve member of the said sleeve unit at the said outer end of the said hollow sleeve member and having
   1. an upper portion extending above the said hollow sleeve member; and
   2. a lower portion extending below the said hollow sleeve member;

c. the said hollow sleeve member of the said sleeve unit having
   1. an unthreaded centrally arranged section formed therein and having
   2. open inner and outer ends;

d. the said hollow sleeve member having
   1. a transversely extending slot formed therein and extending thereacross between the said upper and lower portions of the said hollow sleeve member and adapted to have that said generally rectangular-shaped base plate member of the said combination clamping and fastening unit extended therethrough into the interior of the said generally rectangular-shaped hollow sleeve member of the said sleeve unit;

e. fastening elements formed integrally with the said combination clamping and fastening member of the said combination clamping and fastening unit on the inner surface thereof an adapted to engage and to penetrate into the said structural unit of the said wood framing structure;

f. a threaded fastening member adapted to be inserted through the said open inner end of the said generally rectangular-shaped hollow sleeve member into the interior thereof and into threaded engagement with the said internally threaded central tubular section of the said generally rectangular-shaped base plate member of the said combination clamping and fastening unit to draw the said base plate member of the said combination clamping and fastening unit through the said transversely extending slot in the said hollow sleeve member of the said hollow sleeve unit and into the hollow interior of the said generally rectangular-shaped hollow sleeve member of the said sleeve unit and thereby urge the said combination clamping and fastening member into clamping engagement with the said wooden structural unit of the said wood framing structure while at the same time causing the said fastening elements on the said clamping and fastening member of the said combination clamping and fastening unit to penetrate into the said wooden structural unit of the said wood framing structure and thereby clamp the said wood framing structure to the said masonry wall at the outer surface thereof.

16. A tying device as defined in claim 15 in which a. the said generally internally threaded central tubular section of the said base plate member of the said combination clamping and fastening unit is formed as an integral part of the said generally rectangular-shaped base plate member of the said combination clamping and fastening unit.

17. A tying device as defined in claim 15 in which a. the said internally threaded central tubular section of the said base plate member of the said combination clamping and fastening unit is formed as an integral part on the said generally rectangular-shaped base plate member of the said combination clamping and fastening unit; and in which b. the said unthreaded section of the said generally rectangular-shaped hollow sleeve member of the said sleeve unit is formed as an integral part of the said generally rectangular-shaped hollow sleeve member of the said sleeve unit.

* * * * *